US008968486B2

(12) United States Patent
Allen et al.

(10) Patent No.: US 8,968,486 B2
(45) Date of Patent: Mar. 3, 2015

(54) RINSE AID RELEASE DETECTION METHOD

(71) Applicant: Whirlpool Corporation, Benton Harbor, MI (US)

(72) Inventors: Douglas T. Allen, Goshen, IN (US); Jonathan D. King, Greenbrier, TN (US); Brooke L. Lau, Saint Joseph, MI (US); Jacek Szostak, Namyslow (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/031,339

(22) Filed: Sep. 19, 2013

(65) Prior Publication Data

US 2014/0014147 A1 Jan. 16, 2014

Related U.S. Application Data

(62) Division of application No. 12/582,789, filed on Oct. 21, 2009, now Pat. No. 8,540,820.

(51) Int. Cl.

| | |
|---|---|
| ***A47L 15/44*** | (2006.01) |
| ***A47L 15/00*** | (2006.01) |
| ***A47L 15/42*** | (2006.01) |

(52) U.S. Cl.

CPC ..... *A47L 15/0034* (2013.01); *A47L 15/0055* (2013.01); *A47L 15/4221* (2013.01); *A47L 15/4297* (2013.01); *A47L 2401/023* (2013.01); *A47L 2401/10* (2013.01); *A47L 2501/03* (2013.01); *A47L 2501/07* (2013.01); *A47L 2501/30* (2013.01)

USPC ..... 134/56 D; 134/58 D; 134/18

(58) Field of Classification Search

USPC ..... 134/18, 56 D, 58 D

See application file for complete search history.

(56) References Cited

U.S. PATENT DOCUMENTS

| | | | | |
|---|---|---|---|---|
| 3,888,269 | A * | 6/1975 | Bashark | 134/57 D |
| 5,603,233 | A * | 2/1997 | Erickson et al. | 68/12.02 |
| 5,797,409 | A * | 8/1998 | Cooper et al. | 134/18 |
| 2003/0196278 | A1 * | 10/2003 | Durfee | 8/158 |
| 2004/0069325 | A1 * | 4/2004 | Cerruti et al. | 134/25.2 |
| 2004/0103926 | A1 * | 6/2004 | Ha | 134/57 D |
| 2004/0163679 | A1 * | 8/2004 | Jung et al. | 134/25.2 |
| 2007/0151578 | A1 * | 7/2007 | Cho et al. | 134/18 |
| 2011/0146716 | A1 * | 6/2011 | Deweerd et al. | 134/18 |

* cited by examiner

*Primary Examiner* — Michael Kornakov
*Assistant Examiner* — Katelyn Whatley

(57) ABSTRACT

A dishwashing machine configured to detect the presence of rinse aid in fluid in a washing chamber of the dishwashing machine. An electronic controller selects the drying stage of the dishwashing cycle based on whether rinse aid is present.

18 Claims, 4 Drawing Sheets

RINSE AID RELEASE DETECTION METHOD

CROSS-REFERENCE TO RELATED APPLICATIONS

The present application represents a divisional application of U.S. patent application Ser. No. 12/582,789 entitled "RINSE AID RELEASE DETECTION METHOD" filed Oct. 21, 2009, currently allowed.

TECHNICAL FIELD

The present disclosure relates generally to a dishwashing machine and more particularly to a mechanism and method of detecting the release of rinse aid into a dishwashing cycle.

BACKGROUND

A dishwashing machine is a domestic appliance into which dishes and other cooking and eating wares (e.g., plates, bowls, glasses, flatware, pots, pans, bowls, and etcetera) are placed to be washed. A dishwasher includes a number of dish racks which support such wares. Some dishwashers employ a rinse chemistry which includes a rinse aid during a dishwashing cycle.

SUMMARY

According to one aspect, a dishwashing machine is disclosed. The dishwashing machine includes a tub defining a washing chamber, a number of dish racks positioned in the washing chamber, and a pump operable to circulate fluid onto the number of dish racks during a dishwashing cycle. The dishwashing machine also includes a turbidity sensor operable to measure turbidity of fluid in the washing chamber and generate an electrical output signal indicative thereof, and an electronic controller electrically coupled to the turbidity sensor. The electronic controller includes a processor and a memory device electrically coupled to the processor. The memory device has stored therein a plurality of instructions which, when executed by the processor, cause the processor to communicate with the turbidity sensor to determine a turbidity level of fluid in the washing chamber, determine presence of a rinse aid in fluid in the washing chamber based on the turbidity level, and modify a drying stage of the dishwashing cycle when rinse aid is present in the fluid.

In some embodiments, the dishwashing machine may further include an electronically-controlled dispenser electrically coupled to the controller. The dispenser may have a receptacle formed therein configured receive the rinse aid and a hatch extending over an opening defined in a front surface of the receptacle. The plurality of instructions stored in the memory device, when executed by the processor, may further cause the processor to operate the dispenser to open the hatch such that the rinse aid may pass from the dispenser into the washing chamber.

In some embodiments, the plurality of instructions, when executed by the processor, may further cause the processor to communicate with the turbidity sensor to determine a first turbidity level before the dispenser is operated to open the hatch, communicate with the turbidity sensor to determine a second turbidity level after the dispenser is operated to open the hatch, and calculate a difference between the second turbidity level and the first turbidity level. Additionally, in some embodiments, the plurality of instructions, when executed by the processor, may further cause the processor to determine the rinse aid is present when the difference between the second turbidity level and the first turbidity level is greater than a predetermined threshold value.

In some embodiments, the dishwashing machine may further include an electric heating element electrically coupled to the controller. The electric heating element may be configured to heat fluid in the washing chamber. The plurality of instructions, when executed by the processor, may further cause the processor to operate the electric heating element to heat fluid in the washing chamber to a first temperature and communicate with the turbidity sensor to determine the turbidity level of fluid in the washing chamber at the first temperature.

In some embodiments, the turbidity sensor may be an optical water indicator sensor. Additionally, in some embodiments, the dishwashing machine may further include a lower spray arm positioned below one of the number of dishracks that is fluidly coupled to the pump to circulate fluid, and an upper spray arm positioned above the lower spray arm that is fluidly coupled to the pump to alternately circulate fluid with the lower spray arm. The dishwashing machine may include a diverter valve electrically coupled to the controller and configured to alternately supply fluid to the upper spray arm and the lower spray arm. The plurality of instructions, when executed by the processor, may further cause the processor to operate the diverter valve to suspend the supply of fluid to the lower spray arm such that the upper spray arm continuously circulates fluid, communicate with the turbidity sensor to determine the first turbidity level and second turbidity level while the upper spray arm continuously circulates fluid, and operate the diverter valve to resume the supply of fluid to the lower spray arm such that the lower spray arm alternately circulates fluid with the upper spray arm.

According to another aspect, a method of detecting a rinse aid in a dishwashing cycle is disclosed. The method includes determining a first turbidity level of fluid in a washing chamber during a rinsing stage of a dishwashing cycle, generating a control signal to operate a dispenser during the rinsing stage, determining a second turbidity level of fluid in the washing chamber after generation of the control signal, determining if a rinse aid is present in fluid in the washing chamber based on the first turbidity level and the second turbidity level, and selecting a drying stage of the dishwashing cycle based on whether the rinse aid is present. In some embodiments, determining if the rinse aid is present may include comparing the second turbidity level to the first turbidity level and concluding the rinse aid is not present if the second turbidity level is less than the first turbidity level.

Additionally, in some embodiments, determining if the rinse aid is present may include determining whether the second turbidity level is greater than or equal to the first turbidity level, calculating a difference between the second turbidity level and the first turbidity level when the second turbidity level greater than or equal to the first turbidity level, and concluding the rinse aid is present when the difference between the second turbidity level and the first turbidity level exceeds a predetermined threshold value. In some embodiments, selecting the drying stage of the dishwashing cycle may include selecting a standard drying stage having a standard duration and a standard temperature if the rinse aid is not present in fluid.

In some embodiments, selecting the drying stage of the dishwashing cycle may include selecting a modified drying stage having a duration less than the standard duration when the rinse aid is present in fluid. Additionally, in some embodiments, selecting the drying stage of the dishwashing cycle may include selecting a modified drying stage having a temperature less than the standard temperature when the rinse aid is present in fluid.

In some embodiments, the method may include supplying fluid to an upper spray arm and a lower spray arm such that the upper spray arm and the lower spray arm alternately circulate fluid in a washing chamber, suspending the supply of fluid to the lower spray arm before determining the first turbidity level such that fluid is circulated continuously from the upper spray arm, and resuming the supply of fluid to the lower spray arm after determining the second turbidity level.

According to another aspect, a method of operating a dishwashing machine is disclosed. The method includes heating fluid in the washing chamber to a first temperature during a rinsing stage of a dishwashing cycle, opening a rinse aid dispenser of the dishwashing machine at a predetermined time during the rinsing stage, determining if a rinse aid is present in the fluid in the dishwashing machine based on a first turbidity level and a second turbidity level subsequent to opening the rinse aid dispenser, heating the fluid in the washing chamber to a second temperature subsequent to opening the rinse aid dispenser, and completing the rinsing stage at the second temperature. In some embodiments, the method may further include adjusting a drying stage of the dishwashing cycle if the rinse aid is present in fluid in the dishwashing machine.

Additionally, in some embodiments, the method may further include determining the first turbidity level with an optical water indicator sensor prior to opening the rinse aid dispenser, and determining the second turbidity level with the optical water indicator sensor subsequent to opening the rinse aid dispenser. In some embodiments, determining if a rinse aid is present in fluid may include comparing a first turbidity level to a second turbidity level, and concluding the rinse aid is present when the second turbidity level exceeds the first turbidity level by a predetermined threshold value.

BRIEF DESCRIPTION OF THE DRAWINGS

The detailed description particularly refers to the following figures, in which.

DETAILED DESCRIPTION OF THE DRAWINGS

Figure 1:
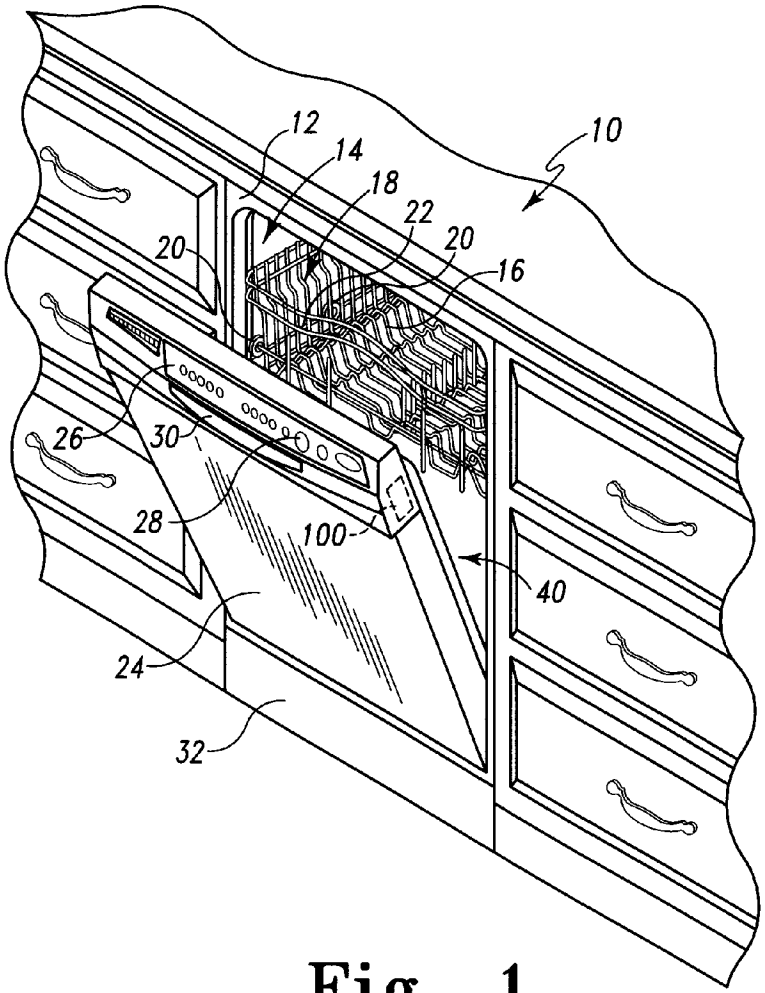
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

The present disclosure relates to a method for detecting the release of rinse aid into a rinse stage of a dishwashing cycle. By use of the term "dishwashing cycle," it is meant the operation of a dishwasher upon a set of soiled wares that produces a set of cleaned wares, starting with user activation, then proceeding continuously without the need for user intervention, and including at least one washing stage and at least one rinsing stage. A washing stage involves the application of a wash chemistry, typically water and detergent, to remove soils from the wares. A rinsing stage involves the application of a rinse chemistry, typically water and rinse aid, to remove the wash chemistry and prepare the wares for drying. A dishwashing cycle may optionally include other stages, such as a drying stage in which heat is applied after the rinsing stage. A dishwashing cycle may be interrupted by a user, such as by opening a door of the dishwasher, thereby causing the dishwashing cycle to pause until the door is closed. However, without such user intervention, the dishwashing cycle will proceed continuously.

At the completion of a dishwashing cycle, a user will remove the set of cleaned wares, either immediately or after a period of time. The period between the dishwashing cycles of the dishwasher thus begins when the user removes a set of cleaned wares from the dishwasher and ends when the user activates a subsequent dishwashing cycle.

Referring to FIG. 1, a dishwashing machine 10 (hereinafter dishwasher 10) is shown. The dishwasher 10 has a tub 12 that defines a washing chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1; although a lower dish rack is also included in the dishwasher 10. A number of roller assemblies 18 are positioned between the dish racks 16 and the tub 12. The roller assemblies 18 allow the dish racks 16 to extend from and retract into the tub 12, thereby facilitating the loading and unloading of the dish racks 16. The roller assemblies 18 include a number of rollers 20 that move along a corresponding support rail 22.

A door 24 is hinged to the lower front edge of the tub 12. The door 24 permits user access to the tub 12 to load and unload the dishwasher 10. The door 24 also seals the front of the dishwasher 10 during a dishwashing cycle. A control panel 26 is located at the top of the door 24. The control panel 26 includes a number of controls 28, such as buttons and knobs, which are used to control the operation of the dishwasher 10. A handle 30 is also included on the door 24. The user may use the handle 30 to unlatch the door 24 such that the door 24 may be opened.

A machine compartment 32 is located below the tub 12. The machine compartment 32 is sealed from the tub 12. In other words, unlike the tub 12, which is filled with fluid and exposed to spray during the dishwashing cycle, the machine compartment 32 does not fill with fluid and is not exposed to spray during the operation of the dishwasher 10. The machine compartment 32 houses components such as the dishwasher's water pump(s) and valve(s), along with the associated wiring and plumbing. It should be noted that, although FIG. 1 depicts a dishwasher 10 installed in a kitchen cabinet, portable dishwashers, which may be removably connected to a faucet, are also contemplated.

Figure 2:
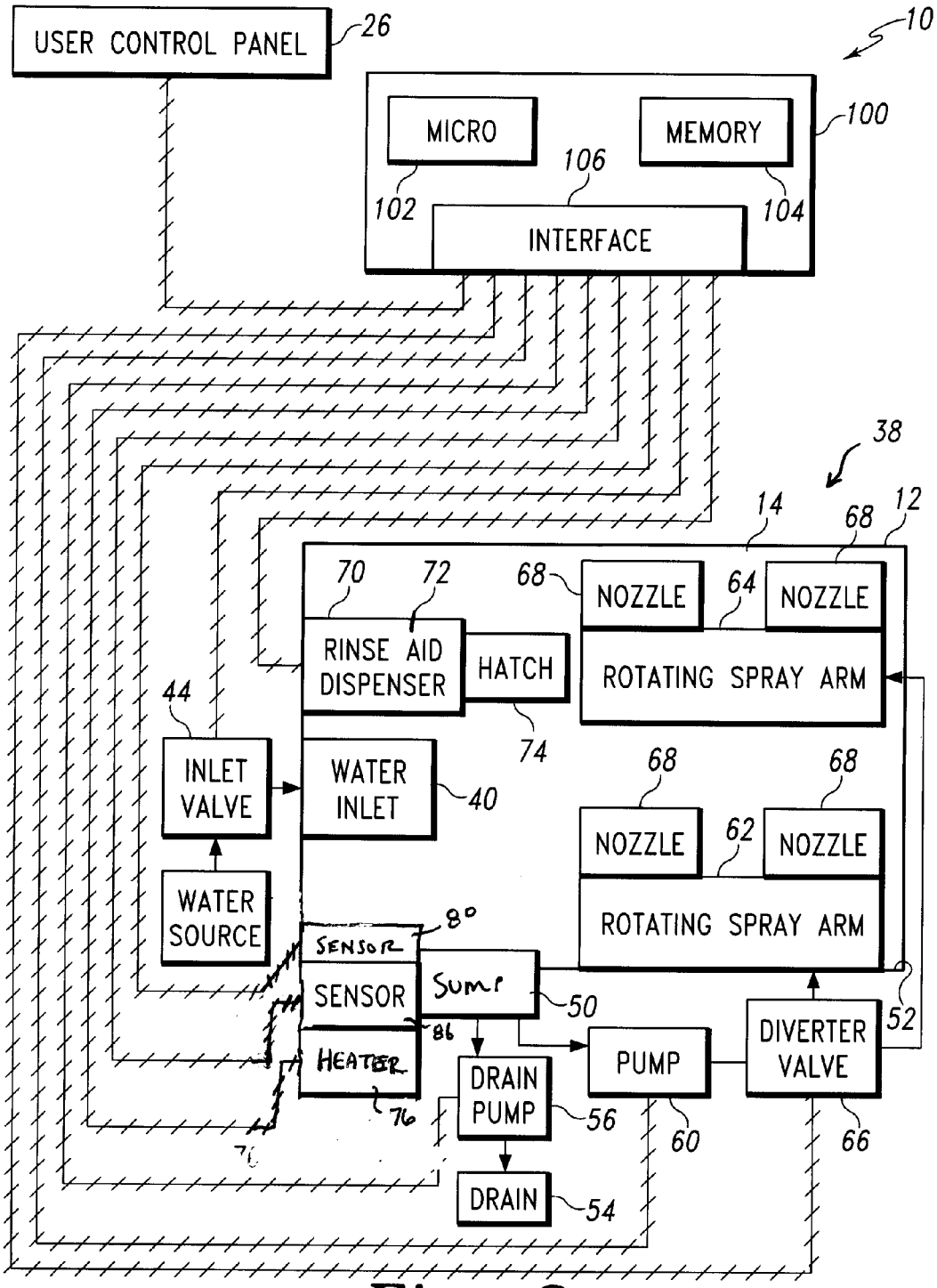
FIG. 2 is a simplified block diagram of one illustrative embodiment of a control system for the dishwashing machine of FIG. 1.

Referring now to FIG. 2, the dishwasher 10 is shown in a simplified block diagram. A sidewall of the tub 12 includes a water inlet 40. The water inlet 40 directs water received from an external water source 42 (e.g., house water supply, kitchen faucet, etcetera) into the washing chamber 14. A water inlet valve 44 positioned between the external water source 42 and the water inlet 40 may be selectively opened or closed to control the flow of water through the water inlet 40. In some embodiments, the water inlet valve 44 may be an electromechanical valve, such as a solenoid-controlled valve, which opens and closes in response to a control signal.

The dishwasher 10 further includes a sump 50 which is formed (e.g., stamped) into a bottom wall 52 of the tub 12. In particular, the sump 50 defines a reservoir that extends downwardly in a direction away from the washing chamber 14. The bottom wall 52 of the tub 12 has a sloped configuration that directs the wash chemistry or the rinse chemistry into the sump 50. The sump 50 is connected to an external drain 54 (e.g., house sewer line, kitchen sink, etcetera). A drain pump 56 is positioned between the sump 50 and the external drain 54. A control signal may selectively energize the drain pump 56 to drain fluids from the sump 50 or de-energize (turn off) the drain pump 56 to retain fluids in the sump 50. In other embodiments, an electromechanical valve, such as a solenoid-controlled valve, that opens and closes in response to a control signal may be used in place of drain pump 56.

A wash pump 60 located in the machine compartment 32 is operable to circulate fluids in the sump 50 onto the dish racks 16 (not shown in FIG. 2). The wash pump 60 is fluidly coupled to a lower rotating spray arm 62 and an optional upper rotating spray arm 64 through a diverter valve 66. The spray arms 62, 64 are configured to spray water and/or wash chemistry onto the dish racks 16 (and hence any wares positioned thereon). It should also be appreciated that the dishwashing machine 10 may include other spray arms positioned at various locations in the tub 12. As shown in FIG. 2, the spray arms 62, 64 have a number of nozzles 68. In operation, the wash pump 60 is selectively energized to supply fluid from the sump 50 through diverter valve 66 to one of the spray arms 62, 64, where the fluid is then expelled out one of the nozzles 68.

The diverter valve 66 is positioned between the spray arms 62, 64 and the wash pump 60. The diverter valve 66 is configured to divert the supply of fluid from wash pump 60 to the lower spray arm 62 and the upper spray arm 65. When placed in one position, the diverter valve 66 causes fluid to be supplied to the lower spray arm 62. When placed in another position, fluid is supplied to the upper spray arm 64. In that way, the diverter valve 66 allows fluid to be alternately supplied to each of the spray arms 62, 64, and only one of the spray arms 62, 64 sprays fluid onto the dishracks 16 at any given moment during the dishwashing cycle. In some embodiments, the diverter valve 66 may be locked in position such that fluid is supplied only to the upper spray arm 64, which continuously sprays fluid onto the dishracks 16.

The dishwasher 10 also includes a rinse aid dispenser 70 that operates to introduce a rinse aid, typically in either liquid or gel form, into the washing chamber 14. A "rinse aid" may include a surface acting agent (also known as a surfactant), one or more sanitizing chemicals (such as bleach, for example), or both, and may contain other chemistries. A rinse aid may be a single mixture or may be stored as two or more separate components until introduction into the washing chamber 14. By way of illustrative example, a rinse aid might contain about 66.67% surfactant by volume and about 33.33% bleach by volume. It should be appreciated that embodiments in which the rinse aid includes a surfactant or a sanitizing chemical, but not both, are also contemplated.

The rinse aid dispenser 70 includes a receptacle 72 positioned in the washing chamber 14. The receptacle 72 is sized to receive the rinse aid in gel or tablet form. A hatch 74 extends over the receptacle 72 and is movable between an open position where access is permitted to the receptacle 72 and a closed position where access to the receptacle is blocked. In some embodiments, the rinse aid dispenser 70 may include an electromechanical valve, such as a solenoid-controlled valve, which opens and/or closes the hatch 74 in response to a control signal. When the hatch 74 is moved to the open position, rinse aid is permitted to move out of the receptacle 72 into the washing chamber 14. Upon introduction, the rinse aid mixes with fluid in the washing chamber 14 to form a rinse chemistry that assists in rinsing the wash chemistry from the wares during a rinsing stage. Applying the rinse chemistry to the wares also improves the drying performance of dishwasher 10 and assists in sanitizing the wares during the drying stage of the dishwashing cycle.

An electric heating element 76 is positioned adjacent to the sump 50 and is configured to heat fluid in the sump 50. During a drying stage of the dishwashing cycle when fluid is not being circulated in the washing chamber 14, the electric heating element 76 is configured to increase the temperature in the washing chamber 14 to dry the wares positioned therein. It will be appreciated that in other embodiments the electric heating element 76 may be integrated into the sump 50 or may be embodied as one or more electric heating elements.

A turbidity sensor 80 is positioned in or adjacent to the washing chamber 14 to monitor the turbidity of fluid in the washing chamber 14. As embodied in FIG. 2, the turbidity sensor 80 is an optical water indicator sensor that provides an indication of fluid clarity at any point during the dishwashing cycle and generates an electrical output signal indicative of the turbidity level of the fluid. The output signal is proportionate to the amount of soil, detergent, or rinse aid present in fluid in the washing chamber 14. As the amount of soil, detergent, or rinse aid increases, the output signal increases by a proportionate amount.

A temperature sensor 86 may be optionally positioned in or adjacent to the washing chamber 14 to measure the temperature of fluid in the washing chamber 14. The temperature sensor 86 is configured to take a temperature measurement of the fluid in the washing chamber 14 and generate an electrical output signal indicative of that measurement.

The dishwasher 10 also includes an electronic control unit (ECU) or "electronic controller" 100. The electronic controller 100 may be positioned in the door 24 or the machine compartment 32 of the dishwasher 10. The electronic controller 100 is, in essence, the master computer responsible for interpreting electrical signals sent by sensors associated with the dishwasher 10 and for activating or energizing electronically-controlled components associated with the dishwasher 10. For example, the electronic controller 100 is configured to control operation of the various components of the dishwasher 10, including the wash pump 60, rinse aid dispenser 70, and inlet valve 44. The electronic controller 100 also monitors various signals from the control panel 26 and the turbidity sensor 80. The electronic controller 100 also determines when various operations of the dishwasher 10 should be performed. As will be described in more detail below with reference to FIGS. 3 and 4, the electronic controller 100 is operable to control the components of the dishwasher 10 such that the dishwasher 10 detects when rinse aid is in fluid in the washing chamber 14 and adjusts the drying stage of the dishwashing cycle in response thereto.

To do so, the electronic controller 100 includes a number of electronic components commonly associated with electronic units utilized in the control of electromechanical systems. For example, the electronic controller 100 may include, amongst other components customarily included in such devices, a processor such as a microprocessor 102 and a memory device 104 such as a programmable read-only memory device ("PROM") including erasable PROM's (EPROM's or EEPROM's). The memory device 104 is provided to store, amongst other things, instructions in the form of, for example, a software routine (or routines) which, when executed by the microprocessor 102, allows the electronic controller 100 to control operation of the dishwasher 10.

The electronic controller 100 also includes an analog interface circuit 106. The analog interface circuit 106 converts the output signals from various sensors (e.g., the turbidity sensor 80) into signals which are suitable for presentation to an input of the microprocessor 102. In particular, the analog interface circuit 106, by use of an analog-to-digital (A/D) converter (not shown) or the like, converts the analog signals generated by the sensors into digital signals for use by the microprocessor 102. It should be appreciated that the A/D converter may be embodied as a discrete device or number of devices, or may be integrated into the microprocessor 102. It should also be appreciated that if any one or more of the sensors associated with the dishwasher 10 generate a digital output signal, the analog interface circuit 106 may be bypassed.

Similarly, the analog interface circuit 106 converts signals from the microprocessor 102 into output signals which are suitable for presentation to the electrically-controlled components associated with the dishwasher 10 (e.g., the rinse aid dispenser 70). In particular, the analog interface circuit 106, by use of a digital-to-analog (D/A) converter (not shown) or the like, converts the digital signals generated by the microprocessor 102 into analog signals for use by the electronically-controlled components associated with the dishwasher 10. It should be appreciated that, similar to the A/D converter described above, the D/A converter may be embodied as a discrete device or number of devices, or may be integrated into the microprocessor 102. It should also be appreciated that if any one or more of the electronically-controlled components associated with the dishwasher 10 operate on a digital input signal, the analog interface circuit 106 may be bypassed.

Thus, the electronic controller 100 may control operation of the dishwasher 10 based the presence of the rinse aid in fluid in the washing chamber 14. In particular, the electronic controller 100 executes a routine including, amongst other things, a control scheme in which the electronic controller 100 monitors outputs of the sensors associated with the dishwasher 10 to control the inputs to the electronically-controlled components associated therewith. To do so, the electronic controller 100 communicates with the sensors associated with the dishwasher 10 to determine, amongst numerous other things, the temperature of fluid in the washing chamber 14 and the turbidity of fluid in the washing chamber 14. Armed with this data, the electronic controller 100 performs numerous calculations, either continuously or intermittently, including looking up values in preprogrammed tables, in order to execute algorithms to perform such functions as controlling the drain pump 56 to retain fluid in the sump 50, determining when to operate the hatch 74 of the rinse aid dispenser 70, controlling the wash pump 60 to apply fluid the wares positioned in the dishwasher 10, and so on.

As will be appreciated by those of the skill in the art, the dishwasher 10 may include elements other than those shown and described above, such as, by way of example, an additional electric heating element to assist in drying the wares or a filter to remove particulates from the re-circulated wash chemistry or rinse chemistry. The dishwasher 10 may also include a variety of other sensors that monitor conditions within the washing chamber 14, the sump 50, and/or other components of the dishwasher 10. It should also be appreciated that the location of many components (i.e., in the washing chamber 14, in the machine compartment 32, in or on the door 24) may also be altered.

Figure 3:
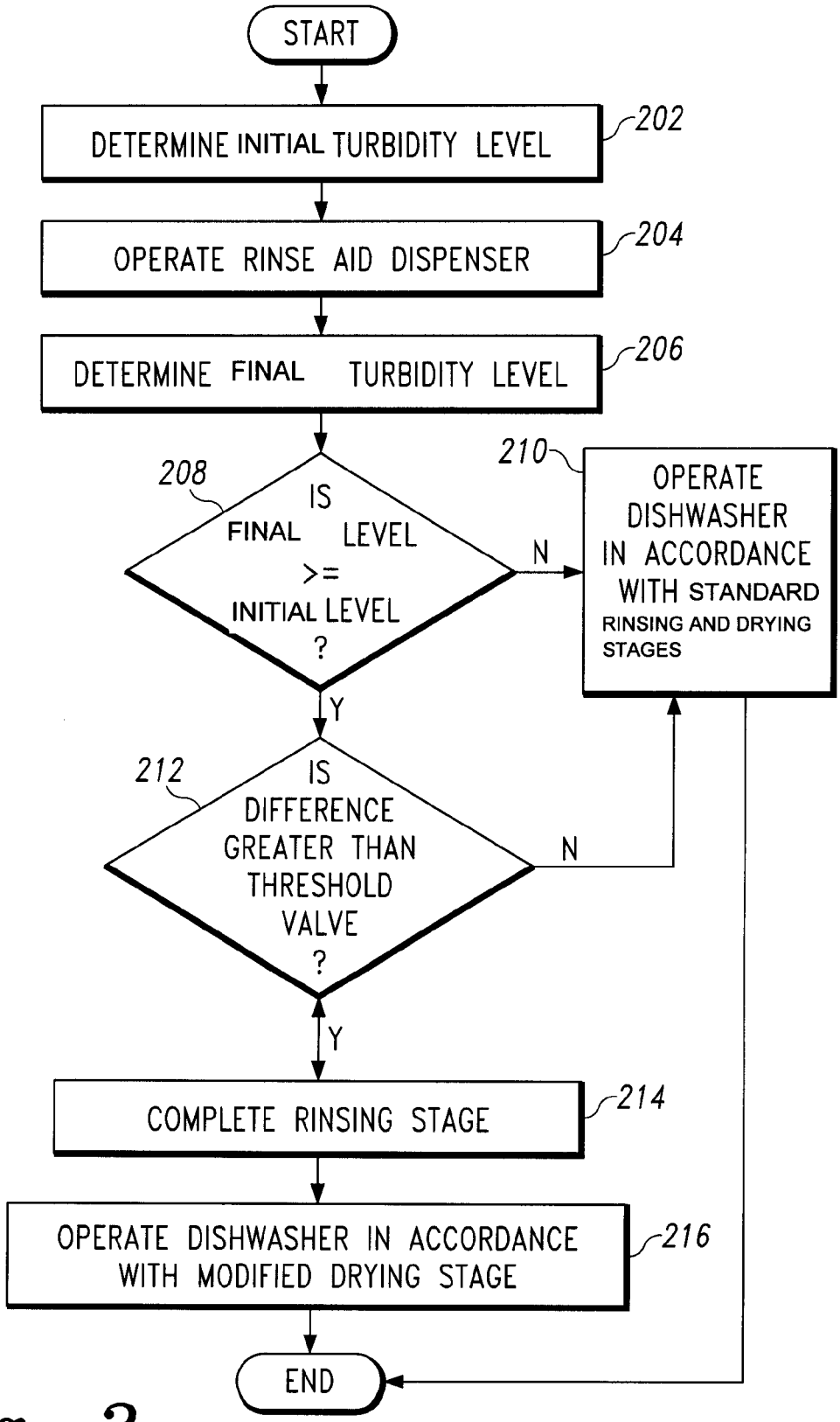
FIG. 3 is a simplified flow chart of a control routine for detecting rinse aid in fluid in a dishwashing machine.

Referring now to FIG. 3, an illustrative embodiment of a control routine 200 for detecting rinse aid in fluid of the washing chamber 14 is shown. The routine 200 begins with step 202 in which the controller 100 communicates with the turbidity sensor 80 to determine the turbidity level of fluid after the start of the rinsing stage. In the illustrative embodiment described herein, the turbidity sensor 80 measures the clarity of the fluid and generates a electrical output signal indicative thereof. While step 202 is performed after the start of the rinsing stage of the dishwashing cycle after the sump 50 has been filled with fluid, it may be performed before the wash pump 60 is operated to circulate fluid in the washing chamber 14 or after the wash pump 60 has already begun doing so. Once the turbidity level has been determined, the routine 200 advances to step 204.

In step 204, the controller 100 operates the rinse aid dispenser 70 to move the hatch 74 to the open position at a predetermined time during the rinsing stage. Opening the hatch 74 permits the rinse aid in the receptacle 72 to advance into the washing chamber 14. In some embodiments, fluid expelled from the nozzles 68 of the spray arms 62, 64 contacts the rinse aid in the receptacle 72 and causes the introduction of the rinse aid into the washing chamber 14. As discussed above, upon introduction the rinse aid mixes with fluid in the washing chamber 14 to form a rinse chemistry that assists in rinsing the wares during the rinsing stage. Once the hatch 74 has been opened, the routine 200 advances to step 206.

In step 206, the controller 100 communicates with the turbidity sensor 80 to determine another turbidity level of the fluid in the washing chamber 14. To do this, the turbidity sensor 80 again measures the clarity of the fluid at a predetermined time after operating the rinse aid dispenser 70 and generates an electrical output signal indicative thereof. Once the additional turbidity level has been determined, the routine 200 advances to step 208.

In step 208, the controller 100 compares the turbidity level determined after the hatch 74 was opened (i.e., the final turbidity level) to the turbidity level determined before it was opened (i.e., the initial turbidity level). When the final turbidity level is less than the initial turbidity level, the controller 100 concludes that the turbidity measurements have likely been influenced by air bubbles or soil and is unable to determine whether rinse aid has been added to fluid in the washing chamber 14. As a result, the routine 200 advances to step 210 in which the dishwasher 10 is operated at the conclusion of the rinsing stage in accordance with a standard or default drying stage having standard duration and temperature settings.

Returning to step 208, if the final turbidity level is greater than or equal to the initial turbidity level, the routine 200 advances to step 212. In step 212, the controller 100 determines a numerical difference between the final turbidity level and the initial turbidity level and compares that numerical difference to a predetermined threshold value. If the difference is less than the threshold value, the controller 100 concludes that the rinse aid is not present in fluid, and the routine 200 proceeds to step 210. As discussed above, in step 210 the controller 100 operates the dishwasher 10 in accordance with a standard drying stage.

When the difference is greater than or equal to the threshold value, the controller 100 concludes that the rinse aid is present in fluid in the washing chamber 14, and the routine 200 advances to step 214. In step 214, the controller 100 operates the dishwasher 10 to complete the rinsing stage before selecting a modified drying stage in step 216.

As discussed above, the addition of rinse aid to fluid during a rinsing stage improves the drying performance of dishwasher 10 and assists in sanitizing the wares during the drying stage of the dishwashing cycle. As such, when the rinse aid is detected in the washing chamber 14 in step 212, the controller 100 adjusts the duration and/or temperature of the drying stage. In that way, the overall cycle time, cost, and environmental impact of the dishwashing cycle can be reduced based on the detection of the rinse aid. As such, in step 218, the controller 100 operates the dishwasher 10 in accordance with a drying stage having a duration that is less than the standard duration setting, a temperature that is less than the standard temperature setting, or some combination of both.

Figure 4:
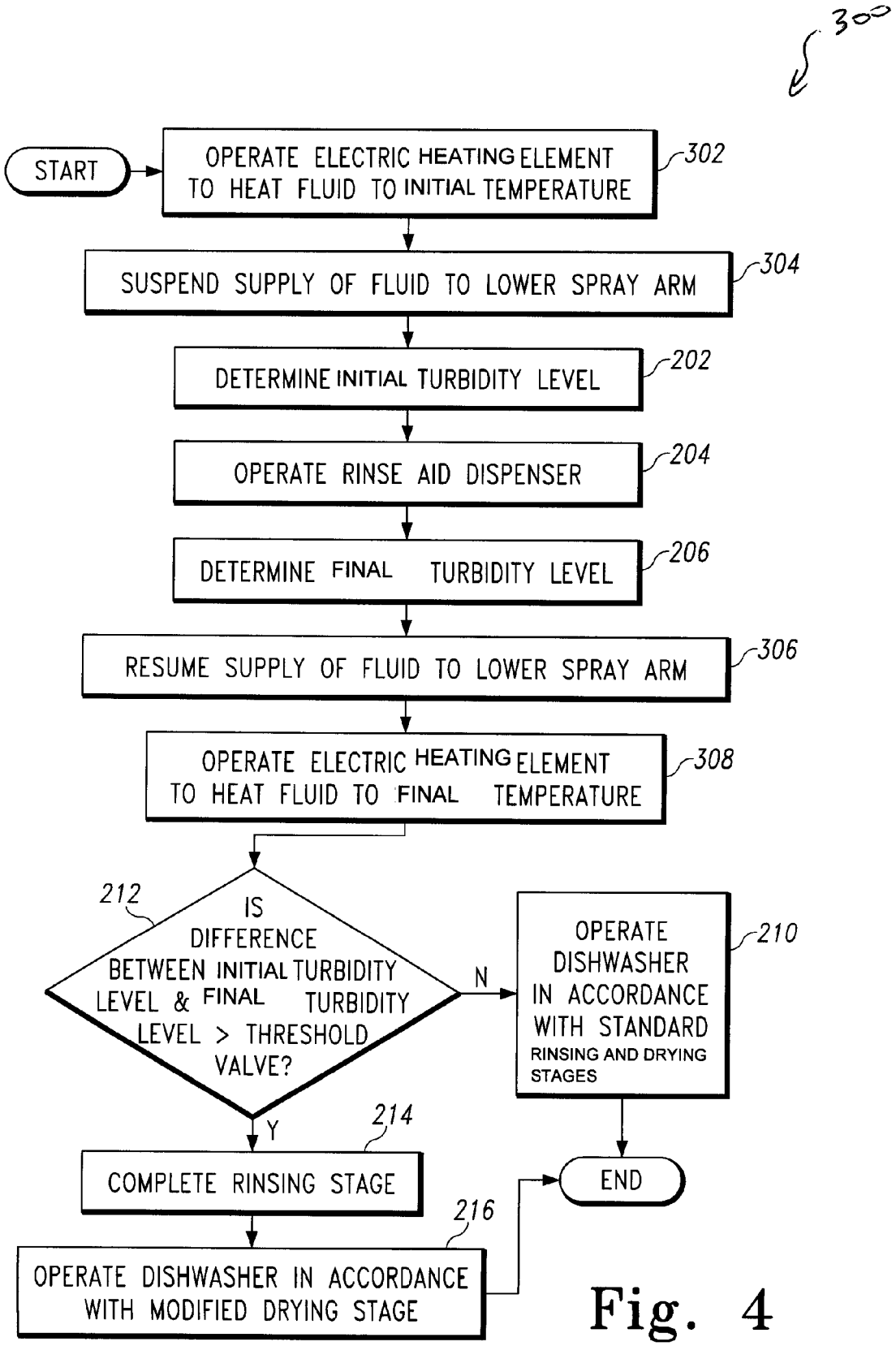
FIG. 4 is a simplified flow chart of a control routine for operating a dishwashing machine and detecting rinse aid in fluid in the dishwashing machine.

Referring to FIG. 4, an illustrative control routine (i.e., routine 300) for operating the dishwasher 10 is illustrated. Some steps of the routine 300 are substantially similar to those discussed above in reference to the embodiment of FIG. 3. Such steps are designated in FIG. 4 with the same reference numbers as those used in FIG. 3. The routine 300 begins with step 302 after the sump 50 has been filled with fluid. In step 302, the controller 100 operates the electric heating element 76 to heat fluid in the washing chamber 14 to an initial fluid temperature. The initial fluid temperature may be a predetermined temperature selected to assist in creating optimum conditions in the washing chamber 14 for the detection of rinse aid.

After the fluid is heated to the initial fluid temperature, the routine 300 advances to step 304. In step 304, the controller 100 operates the diverter valve 66 to supply fluid only to the upper spray arm 64, thereby deactivating the lower spray arm 62. The routine 300 then advances to steps 202-206, which were described above in reference to FIG. 3. As described above, the controller 100 determines an initial turbidity level of fluid in the washing chamber 14 before operating the dispenser 70 to open the hatch 74. After the hatch 74 is opened, the controller 100 determines a final turbidity level of fluid in the washing chamber 14.

After determining the two turbidity levels, the routine advances to step 306. In step 306, the controller 100 operates the diverter valve 66 to alternately supply fluid to both spray arms 62, 64, thereby reactivating lower spray arm 62. The routine 300 then proceeds to step 308 in which the controller 100 operates the electric heating element 76 to heat fluid in the washing chamber 14 to a final fluid temperature at which the dishwasher 10 completes the rinsing stage.

After doing so, the routine 300 proceeds to step 212 and completes the dishwashing cycle in the same manner as described above in regard to FIG. 3. In particular, when the rinse aid is present in the fluid in the washing chamber 14, the controller 100 operates the dishwasher 10 to complete the rinsing stage before selecting, in step 216, a modified drying stage and operating the dishwasher 10 in accordance therewith.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A dishwashing machine, comprising:

a tub defining a washing chamber, a number of dish racks positioned in the washing chamber, a pump operable to circulate fluid during a dishwashing cycle, at least one sprayer to spray fluid from the pump onto the number of dish racks during the dishwashing cycle, a dispenser for introducing a rinsing aid into the washing chamber for a rinsing stage of the dishwashing cycle, a turbidity sensor operable to measure turbidity of fluid in the washing chamber and generate an electrical output signal indicative thereof, and an electronic controller electrically coupled to the turbidity sensor, the controller comprising (i) a processor, and (ii) a memory device electrically coupled to the processor, the memory device having stored therein a plurality of instructions which, when executed by the processor, is configured to cause the processor to:

(a) communicate with the turbidity sensor to determine a first turbidity level of fluid in the washing chamber while fluid is being sprayed into the washing chamber of the dishwashing cycle, (b) generate a control signal to operate the dispenser for the rinsing stage, (c) determine a second turbidity level of fluid in the washing chamber while fluid is being sprayed into the washing chamber, (d) determine a presence of rinse aid in fluid in the washing chamber based on a difference between the first and second turbidity levels, and (d) modify a drying stage of the dishwashing cycle when rinse aid is present in the fluid.

2. The dishwashing machine of claim 1, wherein the dispenser is electrically coupled to the controller, the dispenser having a receptacle formed therein configured to receive the rinse aid and a hatch extending over an opening defined in a front surface of the receptacle, and wherein the plurality of instructions, when executed by the processor, further cause the processor to operate the dispenser to open the hatch such that the rinse aid may pass from the dispenser into the washing chamber.

3. The dishwashing machine of claim 1, wherein the plurality of instructions, when executed by the processor, further cause the processor to determine the rinse aid is present when the difference between the second turbidity level and the first turbidity level is greater than a predetermined threshold value.

4. The dishwashing machine of claim 1, further comprising an electric heating element electrically coupled to the controller, wherein:

the electric heating element is configured to heat fluid in the washing chamber, and the plurality of instructions, when executed by the processor, further cause the processor to:

(a) operate the electric heating element to heat fluid in the washing chamber to a first temperature, and (b) communicate with the turbidity sensor to determine the turbidity level of fluid in the washing chamber at the first temperature.

5. The dishwashing machine of claim 1, wherein the turbidity sensor is an optical water indicator sensor.

6. The dishwashing machine of claim 1, further comprising:

a lower spray arm positioned below one of the number of dish racks, the lower spray arm being fluidly coupled to the pump to circulate fluid, and an upper spray arm positioned above the lower spray arm, the upper spray arm being fluidly coupled to the pump to alternately circulate fluid with the lower spray arm, a diverter valve electrically coupled to the controller and configured to alternately supply fluid to the upper spray arm and the lower spray arm, wherein the plurality of instructions, when executed by the processor, further cause the processor to:

(a) operate the diverter valve to suspend a supply of fluid to the lower spray arm such that the upper spray arm continuously circulates fluid, (b) communicate with the turbidity sensor to determine the turbidity level and a second turbidity level while the upper spray arm continuously circulates fluid, and (c) operate the diverter valve to resume the supply of fluid to the lower spray arm such that the lower spray arm alternately circulates fluid with the upper spray arm.

7. The dishwashing machine of claim 6, wherein the diverter valve is located between the lower spray arm and the pump.

8. The dishwashing machine of claim 1, further comprising:

a lower spray arm positioned below one of the number of dish racks, the lower spray arm being fluidly coupled to the pump to circulate fluid, and an upper spray arm positioned above the lower spray arm, the upper spray arm being fluidly coupled to the pump to alternately circulate fluid with the lower spray arm, a diverter valve electrically coupled to the controller and configured to alternately supply fluid to the upper spray arm and the lower spray arm, wherein the plurality of instructions, when executed by the processor, further cause the processor to:

(a) operate the diverter valve to suspend a supply of fluid to the upper spray arm such that the lower spray arm continuously circulates fluid, (b) communicate with the turbidity sensor to determine the turbidity level and a second turbidity level while the lower spray arm continuously circulates fluid, and (c) operate the diverter valve to resume the supply of fluid to the upper spray arm such that the upper spray arm alternately circulates fluid with the lower spray arm.

9. The dishwashing machine of claim 8, wherein the diverter valve is located between the lower spray arm and the pump.

10. The dishwashing machine of claim 1, further comprising:

a temperature sensor electrically coupled to the controller, and an electric heating element electrically coupled to the controller, wherein the temperature sensor is configure to measure a temperature of fluid in the washing chamber, the electric heating element is configured to heat fluid in the washing chamber, and the plurality of instructions, when executed by the processor, further cause the processor to:

(a) operate the electric heating element to heat fluid in the washing chamber until the temperature sensor indicates to the controller that a first temperature has been reached, and (b) communicate with the turbidity sensor to determine the turbidity level of fluid in the washing chamber at the first temperature.

11. The dishwashing machine of claim 1, wherein the plurality of instructions, when executed by the processor, further cause the processor to operate an electromechanical valve to open a hatch such that the rinse aid may pass from the dispenser into the washing chamber.

12. The dishwashing machine of claim 1, wherein the electrical output signal is proportionate to an amount of rinse aid present in the fluid in the washing chamber.

13. The dishwashing machine of claim 1, wherein the plurality of instructions, when executed, causes the processor to calculate the difference between the first and second turbidity levels.

14. The dishwashing machine of claim 13, wherein the plurality of instructions, when executed, further causes the processor to conclude that rinse aid is present when the difference exceeds a predetermined amount.

15. A dishwashing machine, comprising:

a tub defining a washing chamber, a number of dish racks positioned in the washing chamber, a pump operable to circulate fluid during a dishwashing cycle, at least one sprayer to spray fluid from the pump onto the number of dish racks during the dishwashing cycle, a heating element to heat fluid in the washing chamber, an electronically-controlled dispenser for introducing a rinsing aid into the washing chamber for a rinsing stage of the dishwashing cycle, a turbidity sensor operable to measure turbidity of fluid in the washing chamber and generate an electrical output signal indicative thereof, and an electronic controller electrically coupled to the turbidity sensor, the controller comprising (i) a processor, and (ii) a memory device electrically coupled to the processor, the memory device having stored therein a plurality of instructions which, when executed by the processor, is configured to cause the processor to:

(a) operate the heating element to heat fluid in the washing chamber to a first temperature, (b) communicate with the turbidity sensor to determine a first turbidity level of fluid in the washing chamber at the first temperature prior to rinsing aid being added to the washing chamber during the dishwashing cycle, (c) operate the dispenser to introduce rinsing aid into the washing chamber, (d) determine a second turbidity level of fluid in the washing chamber after the rinsing aid is introduced into the washing chamber, (e) determine a presence of rinse aid in fluid in the washing chamber based on a difference between the first and second turbidity levels, and (f) modify a drying stage of the dishwashing cycle when rinse aid is present in the fluid.

16. The dishwashing machine of claim 15, wherein the plurality of instructions, when executed, further causes the processor to operate the heating element to heat fluid in the washing chamber to a second temperature prior to completing the rinsing stage.

17. The dishwashing machine of claim 15, wherein the plurality of instructions, when executed, causes the processor to calculate the difference between the first and second turbidity levels.

18. The dishwashing machine of claim 17, wherein the plurality of instructions, when executed, further causes the processor to conclude that rinse aid is present when the difference exceeds a predetermined amount.

* * * * *